United States Patent [19]

Kemp

[11] 4,236,503

[45] Dec. 2, 1980

[54] GRATE WITH ADJUSTABLE VENTS

[75] Inventor: Wayne T. Kemp, Kutztown, Pa.

[73] Assignee: Raytheon Company, Lexington, Mass.

[21] Appl. No.: 956,549

[22] Filed: Oct. 30, 1978

[51] Int. Cl.[3] ..... F24C 15/10

[52] U.S. Cl. ..... 126/215; 126/39 K; 126/214 D

[58] Field of Search ..... 126/215, 39 K, 39 H, 126/40, 286, 214 C, 214 D, 42, 39 E, 217, 218

[56] References Cited

U.S. PATENT DOCUMENTS

| | | | |
|---|---|---|---|
| 554,343 | 2/1896 | Johnson | 126/215 |
| 592,039 | 10/1897 | Albach | 126/39 E |
| 2,159,576 | 5/1939 | Underwood | 126/215 X |

FOREIGN PATENT DOCUMENTS

| | | | |
|---|---|---|---|
| 1012607 | 7/1952 | France | 126/214 |

*Primary Examiner*—Samuel Scott
*Assistant Examiner*—G. Anderson
*Attorney, Agent, or Firm*—William R. Clark; Milton D. Bartlett; Joseph D. Pannone

[57] ABSTRACT

A gas-fueled range having top burners and individual valves for controlling flow of fuel to the burners, each burner being covered by an inverted cup-shaped grate for supporting a utensil to be heated, the grate having vents for permitting exhaust of combustion flue products, and shutter devices operatively connected to the valve and movable therewith to regulate the effective size of the vents in accordance with variations in size of the burner flames.

7 Claims, 6 Drawing Figures

FIG. 1
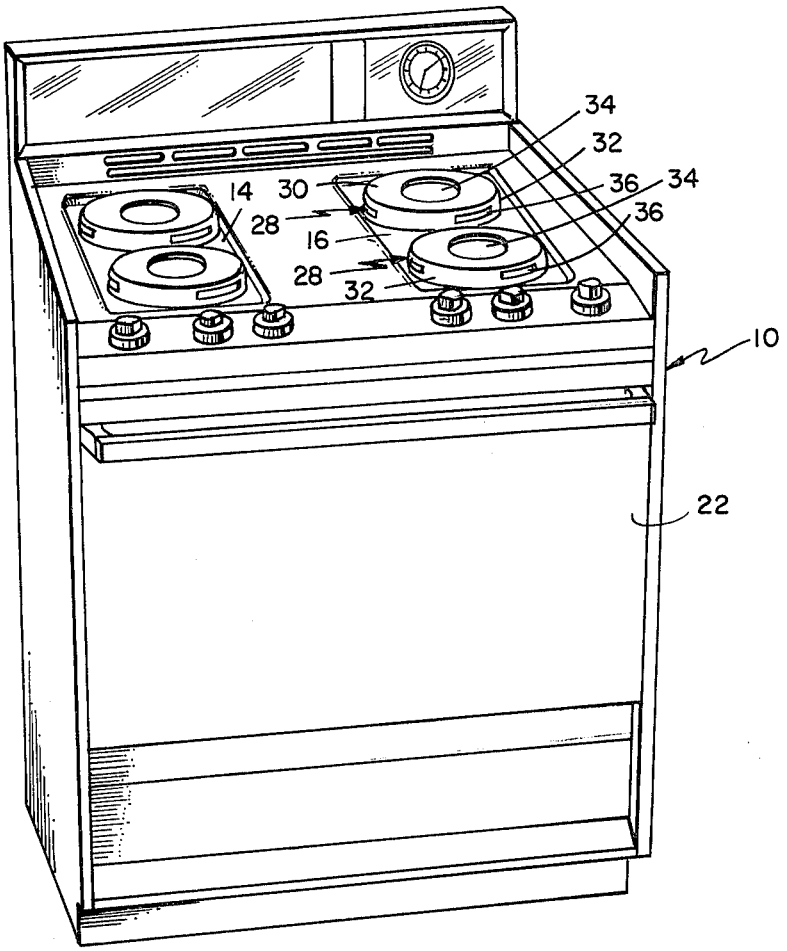
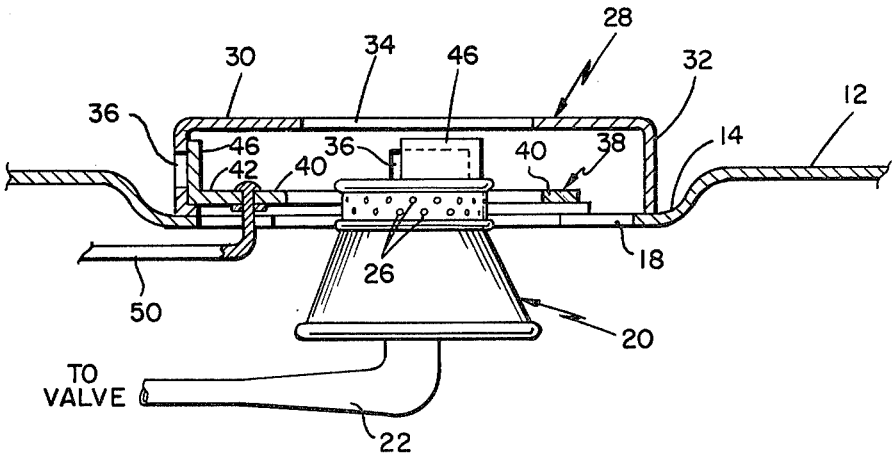
FIG. 2

GRATE WITH ADJUSTABLE VENTS

BACKGROUND OF THE INVENTION

Conventional structures for the top burners of gas-fueled ranges include an open grate which is mounted over the burner so as to support a pot or other utensil above the burner in a position to be heated by the burner flame and by the heat from combustion flue products generated by the flame.

A relatively low flame will efficiently heat the bottom of the utensil since the amount of combustion flue products is relatively low and most of such products will rise to contact the utensil before deflecting sideways into the ambient atmosphere. However, it has been found that when a burner is adjusted so as to produce a high beam, a relatively large amount of combustion flue products is produced. In such a case such flue products, which produce useful heat in themselves, are dispersed in such a manner that as much as fifty per cent of the useful heat may be lost. This results in considerable energy loss and resultant increase in the cost of operation of the burner.

SUMMARY OF THE INVENTION

The present invention overcomes the above and other problems of the prior art by the provision of means for increasing the efficiency of top burners of gas-fueled ranges and consequently producing savings in energy and cost of operation.

These features are achieved, in accordance with this invention, by the provision of a novel grate for use with a top burner, which grate has a central opening in its top for the passage of heat to an overlying utensil, the grate further having a skirt which surrounds the burner and which has at least one vent for controlled escape of combustion flue products and free air.

Means is provided for altering the effective size of the vent in accordance with changes in size of the burner flame, thus controlling the escape of combustion flue products so that optimum heat is retained within the grate and caused to flow upwardly onto the bottom of the utensil without undesired heat loss in a lateral direction. Such means, in accordance with this invention, comprises a movable gate or shutter which is located adjacent the vent and is operatively connected with the manually-operable valve which controls flow of fuel to the burner. Thus, when the valve is operated to increase or lower the burner flame in the well-known manner, the shutter will move relative to the vent to correspondingly increase or decrease the effective size of the vent opening. This has been found to provide a substantial increase in burner efficiency as well as saving in energy.

BRIEF DESCRIPTION OF THE DRAWINGS

The above and other objectives of this invention will become apparent from the following description taken in connection with the accompanying drawings, wherein:

FIG. 1 is an isometric view of a domestic gas-fueled range embodying the invention;

FIG. 2 is a vertical sectional view through one of the burner areas of the range of FIG. 1;

DESCRIPTION OF THE PREFERRED EMBODIMENTS

Figure 3:
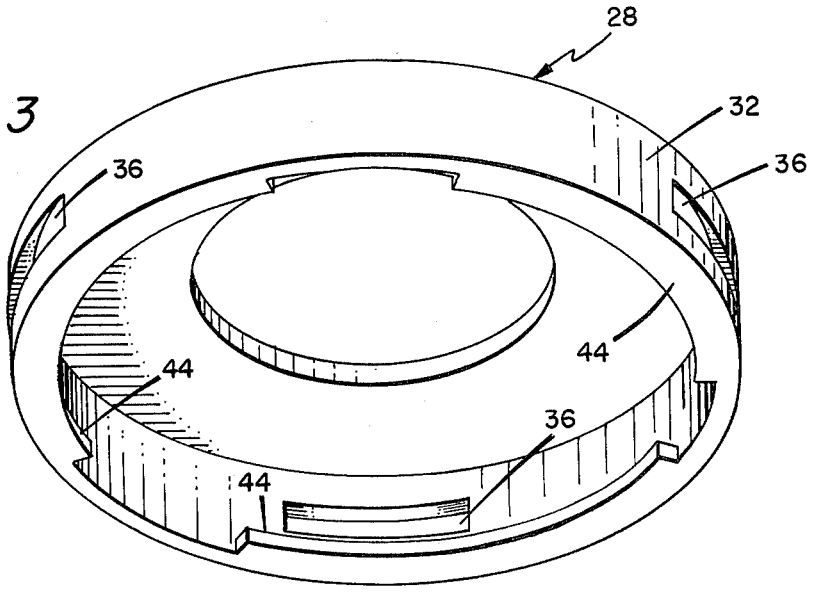
FIG. 3 is a pictorial illustration depicting the under side of a grate utilized in the invention.
Figure 4:
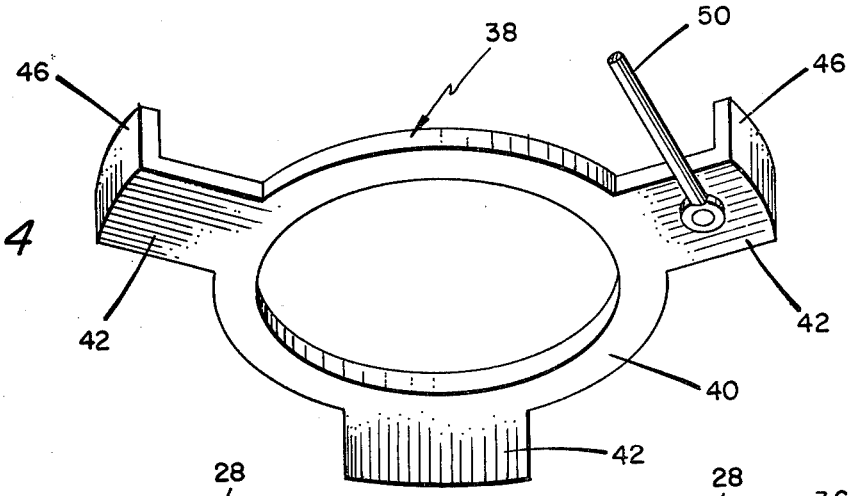
FIG. 4 is a pictorial illustration depicting the under side of a gate or shutter device utilized with the invention.

Referring more particularly to the drawings wherein like characters of reference designate like parts throughout the several views, a domestic gas range 10 is shown in FIG. 1 and includes the usual main cooking top 12 which is usually a single piece of sheet metal extending over substantially the whole upper side of the range. The top 12 is provided with a pair of spaced recessed areas 14 and 16, one at either side of the range, and each recessed area is provided with a front opening 18 and a rear opening, one front opening being shown in FIG. 2.

Projecting upwardly within each opening is a respective front or rear burner 20 which extends upwardly from the conventional burner box which is located above the usual baking and broiling oven 22 and/or storage compartments. The burner box and oven details form no part of the present invention and, therefore, are not shown or described herein. It will be understood that the burner and associated structure shown in FIG. 2 represents any one of the four similar structures in the range of FIG. 1.

The burner 20 is supplied with gas and primary combustion air by venturi tube 22 in the conventional and well known manner from a manifold (not shown). In a pipe (not shown) leading from the manifold to the venturi 22 is a manual control valve which is diagrammatically illustrated in FIGS. 5 and 6 by a valve stem 24 which is rotatable about its longitudinal axis, which axis is parallel to the vertical axis of the burner 20.

In the operation of such a burner 20, the valve will be operated to rotate the stem 24 in the usual manner of gas valves of this character, causing gas to flow into the venturi 22. In the venturi air mixes with the gas, and the mixture flows up into the burner 20. Upon ignition, flames are produced at the burner ports 26, some of the flames being directed straight upwardly, while others are angled slightly outwardly and upwardly as is well known. It will be understood that the burner flames may be raised and lowered by operation of the valve and consequent adjustment of the amount of fuel which flows to the venturi and burner.

Mounted over opening 18, and consequently over the burner 20, is a grate or support 28 for a pot (not shown) to be heated. Grate 28, in accordance with this invention, comprises an inverted dished member having a planar disclike top 30 and a circular integral skirt 32 which depends from the edge of the top 30 throughout its periphery. The skirt 32 encircles the opening 18 and rests upon the surface of the recessed area 16 of cooking top 12. The grate top 30 is provided with a central opening 34 which may be of any selected size, preferably slightly larger than the top of the burner 20, so that the flames from the burner can contact the bottom of a pan positioned on the top 30 of the grate.

It will be apparent that means must be provided for escape of combustion flue products which are produced by the flame. With a pot on the grate and with a high flame on the burner, it is possible that combustion flue products may be produced in sufficient quantity to cause the flame to be smothered. This, of course, is unacceptable. Therefore, in further accordance with this invention there are provided one or more vents 36 in the skirt 32. Thus, combustion flue products as well as free air in the vicinity are allowed to escape.

It is known that combustion flue products contribute substantially to the heating of the bottom of a pot on the grate 28 in addition to the heat produced directly by or from the flames. Therefore, in order to utilize the heat of the combustion flue products to the greatest extent possible without affecting the burner flames, the vents 36 preferably are of a size or area such that when the burner produces maximum high flame, combustion flue products will be allowed to escape only to the extent necessary to sustain production of the flame, thus allowing the optimum amount of combustion flue products to be retained within the enclosing grate to assist in the heating of the pot.

However, it will be apparent that with a reduction in the size of the flames, a proportionately greater amount of combustion flue products will escape through the vents 36. This results in a reduction in efficiency of the burner. This problem is overcome in still further accordance with this invention by regulation of the effective sizes of the openings in accordance with variations in the size of the burner flame. That is when the flame is lowered or reduced, a consequent and proportional reduction in the effective sizes of the vents is effected.

This is achieved by the provision of gate device 38 which comprises a ring 40 having radially projecting arms 42 in a number equal to the number of vents 36. The free end of each arm 42 is slidably positioned on an arcuate ledge 44 on the inside of the skirt 32. The end of each arm 42 has an upstanding shutter element 46 thereon which overlies the inner surface of skirt 32 and slides into and out of covering relation to a respective vent 36. Thus, when the gate device 38 is rotated within skirt 32 to the position shown in FIG. 5, the vents 36 are completely open. This would occur when the burner 20 is producing maximum flame. When the burner is off the gate device 38 will be rotated to the position shown in FIG. 6 wherein the vents 36 are completely closed by the shutters 46.

It will be apparent that when the burner is operated on low flame the gate is rotated to a position where the shutter elements 46 will only partially cover the vents 36. In this way an amount of the combustion flue products is retained within the grate 28 to contribute to the heating of the utensil on the grate, while a sufficient amount of the flue products is allowed to escape through the vents to prevent smothering of the flame.

Figure 5:
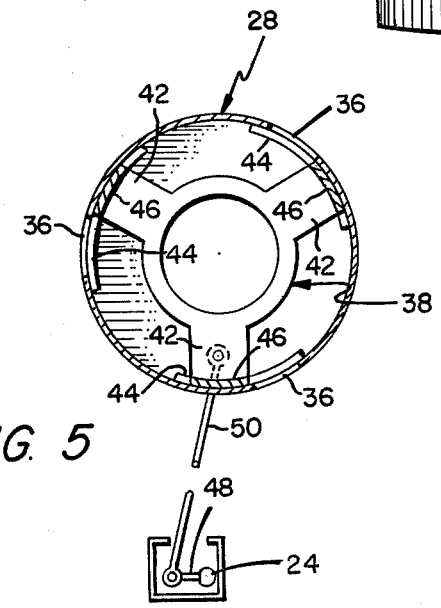
FIGS. 5 and 6 are diagrammatic illustrations of the invention showing the shutter in two different positions.
Figure 6:
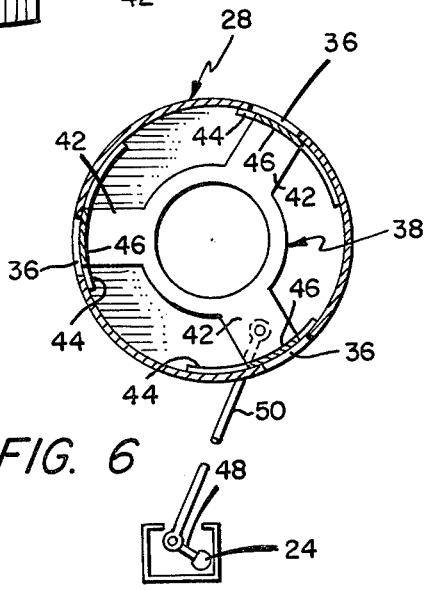

In order to achieve regulation of the exhaust of combustion flue products in accordance with variations in size of the burner flame, preferably proportionately thereto, the rotation of the gate device 38 is effectively controlled by the rotation of the valve 24. One preferred means for accomplishing this is shown in FIGS. 5 and 6 wherein the valve member 24 fixedly carries one end of a crank arm 48. An operating shaft 50 is pivotably attached at one end to the outer end of crank arm 48 and at its other end is pivoted to one of the gate arms 42. Thus, when the valve member 24 is manually rotated to raise and lower a burner flame, the arms 48 and 50 will consequently move the gate device on the ledges 44 to simultaneously adjust the vents 36 and thereby regulate the exhaust of combustion flue products, as described.

From the foregoing it will be apparent that all of the objectives of this invention have been achieved by the structures shown and described. However, it will also be apparent that various modifications and changes in the structures shown and described may be made by those skilled in the art without departing from the spirit of the invention as expressed in the accompanying claims. Therefore, all matter shown and described is to be interpreted as illustrative and not in a limiting sense.

What is claimed is:

1. A gas-fueled appliance comprising:

at least one burner;

piping means for supplying fuel to the burner to produce a flame when ignited together with resultant combustion flue products;

valve means connected to said piping means and adjustable to vary flow of fuel to the burner and consequently vary the size of the burner flame and the amount of combustion flue products produced; and means for regulating the escape of combustion products from the sides of the burner in accordance with variations in size of said burner flame comprising a plurality of vents, a ring encircling said burner and rotatable about the axis of said burner within said grate, a plurality of arms corresponding in number to the number of vents extending radially from said ring, and a shutter element carried by the outer ends of each of said arms and adapted to move with said ring into and out of closing relation to a respective one of said vents.

2. A gas-fueled appliance as set forth in claim 1 wherein:

said shutter elements are operatively connected with said valve means for movement therewith.

3. A gas-fueled appliance as set forth in claim 2 wherein:

said shutter elements are operatively connected to said valve means for simultaneous operation therewith.

4. A gas-fueled appliance comprising:

at least one burner;

piping means for supplying fuel to the burner to produce a flame when ignited together with resultant combustion flue products;

valve means connected to said piping means and adjustable to vary flow of fuel to the burner and consequently vary the size of the burner flame and the amount of combustion flue products produced;

a gate mounted over said burner for supporting a utensil to be heated and having walls which provide substantially complete enclosure of said burner when a utensil is in position on the grate;

said grate having adjustable venting means for permitting escape of combustion flue products from within the grate through a plurality of vents; and said adjustable venting means comprises adjustment means for varying the size of said vents in accordance with variations in the size of said burner flame comprising a ring encircling the burner and rotatable about its axis within the grate, a plurality of arms corresponding in number to the number of vents extending radially from said ring, and shutter elements carried by the ends of said arms and adapted to move with said ring into and out of closing relation to a respective one of said vents.

5. A gas-fueled appliance comprising:

at least one burner;

piping means for supplying fuel to the burner to produce a flame when ignited together with resultant combustion flue products, valve means connected to said piping means and adjustable to vary flow of fuel to the burner and consequently vary the size of the burner flame and the amount of combustion flue products produced;

a grate mounted over said burner for supporting a utensil to be heated and having walls which provide substantially complete enclosure of said burner when a utensil is in position on the grate;

said grate having adjustable venting means for permitting escape of combustion flue products from within the grate comprising a plurality of vents;

said adjustable venting means varying the size of said vents in accordance with variations in the size of said burner flame; and said grate adjustable venting means comprising a disc-like main portion with a central aperture therein, a skirt depending from the edge of said main portion throughout its periphery having said plurality of vents therein, and shutter elements movable into and out of closing relation to said vents.

6. A gas-fueled appliance as set forth in claim 4 wherein:

said adjustment means is operatively connected to said valve for movement therewith.

7. A gas-fueled appliance comprising:

a base having a cooktop;

said cooktop having burner apertures;

burners mounted on said cooktop within respective apertures;

piping means for supplying fuel to the burners to produce a flame when ignited together with combustiion flue products;

valves connected respectively to portions of the piping means associated with respective burners and adjustable to vary the flow of fuel to the respective burners and consequently vary the size of the respective burner flames and the amount of combustion flue products produced thereby;

a grate mounted over each burner for supporting a utensil to be heated;

said grate having a disc-like main portion with a central aperture therein and having a skirt depending from the edge of the main portion throughout its periphery;

the skirt resting on the cooktop around the adjacent aperture;

the skirt having a plurality of vents therein and having at least one arcuate flange on its inner surface beneath and adjacent said apertures;

adjustment means for regulating the escape of combustion flue products through said vents comprising a ring positioned within the grate and having a number of radially extending arms thereon, the outer ends of which are positioned upon said flanges;

said flanges each carrying an upstanding shutter element thereon; and the adjustment means being operatively connected with a respective valve of said valve means whereby movement of the valve will cause corresponding movement of said ring and said arms to move said shutter elements into and out of closing relatiion to said vents.

* * * * *